US007530876B1

(12) United States Patent
Wimberly

(10) Patent No.: US 7,530,876 B1
(45) Date of Patent: May 12, 2009

(54) NOISE GENERATING NOVELTY APPARATUS

(76) Inventor: Greg E. Wimberly, 4334 Wallaby Ct., Antioch, CA (US) 94531

( * ) Notice: Subject to any disclaimer, the term of this patent is extended or adjusted under 35 U.S.C. 154(b) by 322 days.

(21) Appl. No.: 11/636,912

(22) Filed: Dec. 12, 2006

(51) Int. Cl.
*A63H 3/14* (2006.01)
*A63H 33/00* (2006.01)

(52) U.S. Cl. ..... 446/327; 446/26; 2/158; 40/586

(58) Field of Classification Search ..... 446/26–28, 446/327–329; 2/158–160; 40/586; 116/306
See application file for complete search history.

(56) References Cited

U.S. PATENT DOCUMENTS 1,537,811 A * 5/1925 Epling ..... 128/879
2,134,974 A * 11/1938 Hurwitz ..... 40/411
2,751,708 A * 6/1956 Plummer ..... 446/223
4,351,067 A * 9/1982 Bartels ..... 2/160
4,455,963 A 6/1984 Matsuo
4,486,975 A 12/1984 Harrelf et al.
D310,109 S 8/1990 Vega
5,433,025 A * 7/1995 Borghese ..... 40/586
5,881,384 A * 3/1999 Williams ..... 2/158
6,108,817 A 8/2000 Kostelac
6,612,056 B1 * 9/2003 Thomas, II ..... 40/586
7,025,655 B2 * 4/2006 Chase ..... 446/392
D567,476 S * 4/2008 Harland ..... D2/615
2003/0074819 A1 4/2003 Corona
2004/0098894 A1 5/2004 Thomas

* cited by examiner

*Primary Examiner*—Kien Nguyen

(57) ABSTRACT

An apparatus includes a body shaped as a large open-faced hand made from deformably resilient material. The body has a water-impermeable outer surface and a solid core monolithically formed therewith. The solid core has a cavity that has flanges for receiving a user's metacarpals therein. A rectilinear stabilizing bar traverses longitudinally across the body, is statically seated within the solid core, is intercalated between the outer layers, and has a threaded aperture formed at a midpoint thereof. A mechanism is included for covering an arm of the user such that the user's arm is protected from undesirable air-traveling particulates during clapping conditions. The arm is invisible from an exterior of the arm covering mechanism. The arm covering mechanism is formed from flexible and water-impermeable material for prohibiting the user's arm from becoming soaked during inclement weather conditions.

18 Claims, 3 Drawing Sheets

NOISE GENERATING NOVELTY APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to noise generating apparatuses and, more particularly, to a novelty noise generating apparatus for creating loud, clapping and entertaining sounds during sports events and like recreational events.

2. Prior Art

In past years, a variety of promotional novelties have been used such as pins, hats, shirts, helmets, banners and the like. These novelties generally depicted the supported individual or team or supportive expressions and may be decorated with a suitable logo or slogan and team colors. In recent years spectators' interest in promoting individuals or teams has grown considerably. Today, auditoriums, sports arenas and stadiums are built to accommodate larger numbers of spectators. Also, expanded television coverage of spectator events now reaches millions of home viewing spectators.

Today, because the vast majority of spectators are physically isolated and unable to express their support, verbally, among themselves or with the individuals or team members they support, or with home viewing spectators, various forms of non-verbal means of communication have evolved. In recent years, efforts have been made to promote novelty items to allow the spectator to better communicate, visually as well as verbally, his or her support and enthusiasm at various events.

One such novelty device is a polymeric foam device of construction outlining the image of an oversized hand which has an index finger raised in an upright fashion and the balance of the fingers clinched in a fist formation. The spectator utilizes this promotional novelty device by displaying it in a prominent location or by raising it over his head and waving it, to symbolize that his team is "No. 1". However, such devices are passive devices and do not adequately express the spectator's active enthusiasm.

Promotional novelties of this type are bulky and cause difficulty for the spectator to transport them to and from the events and to find adequate space for their storage and use at a crowded event. Also, because of their bulkiness, novelties of this type are often damaged through use, transport, or storage. Some such promotional novelties the user must hold with one or both hands in a clinched fist fashion which causes fatigue to the hand, wrists and arms over prolonged use or the user must place a hand in a slit in the body of the device. The requirement of holding the novelty in these fashions limits or eliminates the use of the hand or hands for other general purposes, such as clapping.

Accordingly, a need remains for a novelty noise generating apparatus in order to overcome the above-noted shortcomings. The present invention satisfies such a need by providing a novelty apparatus that is convenient and easy to use, is lightweight and portable in design, safe to use in large crowds, and gives the wearer the ability to express their support or derision of a certain team. Such an apparatus provides sports fans with a fun and inventive novelty item for use at sporting events. A pair of these devices not only provide noisemakers for showing one's support of a team, but also features a humorous design to be enjoyed by all the spectators. Since each apparatus features a light weight foam or inflatable design, it is safe to use in large crowds. Using the novelty noise generating apparatus also prevents pain in one's hands often caused by excessive clapping and cheering, thus sparing the user a considerable amount of discomfort. People who frequently attend professional, minor league, and college sporting events will find the novelty apparatus quite appealing.

BRIEF SUMMARY OF THE INVENTION

In view of the foregoing background, it is therefore an object of the present invention to provide a novelty noise generating apparatus. These and other objects, features, and advantages of the invention are provided by an apparatus for creating loud, clapping and entertaining sounds during sports events and like recreational events.

The apparatus includes a body shaped as a large open-faced hand made from deformably resilient material. Such a body has an outer surface formed from water-impermeable material and further has a solid core monolithically formed with the outer surface. The solid core is provided with a cavity that has a plurality of flanges for effectively receiving a user's metacarpals therein such that a hand of the user penetrates upwardly from a bottom edge of the body and terminates subjacent midway to a top of the body. Such a cavity preferably extends upwardly from the bottom edge of the body and abuts directly to the stabilizing bar.

A stabilizing bar that has an elongated and rectilinear longitudinal length traverses across a longitudinal length of the body such that the stabilizing bar is seated within the solid core and is intercalated between the outer layer so that the stabilizing bar effectively defines a fulcrum axis about which a top region of the body articulates during side-to-side movement of the body. The stabilizing bar is statically positioned within the body as the top region is repeatedly pivoted about the stabilizing bar. Such a stabilizing bar further has a threaded aperture formed at a midpoint of the longitudinal length thereof.

A mechanism is included for covering an arm of the user such that the user's arm is advantageously and effectively protected from undesirable air-traveling particulates during clapping conditions. Such an arm is invisible from an exterior of the arm covering mechanism during operating conditions. The arm covering mechanism is formed from flexible and water-impermeable material for advantageously and conveniently prohibiting the user's arm from becoming soaked during inclement weather conditions. Such an arm covering mechanism may be directly and permanently coupled to the bottom edge of the body. The arm covering mechanism preferably has open top and bottom ends and is in fluid communication with the cavity and an exterior of the body respectively.

The apparatus may further include a telescopically adjustable rod that is removably inserted through the arm covering mechanism and vertically upward into the cavity. Such a rod has a threaded upper end threadably conjoined directly to the threaded aperture of the stabilizing bar and is medially disposed between axially opposed ends thereof so that the body is effectively maintained at equilibrium when the user arm is seated within the cavity. The rod preferably has a maximum longitudinal length that is shorter than a combined longitudinal length of the cavity and the arm covering mechanism respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
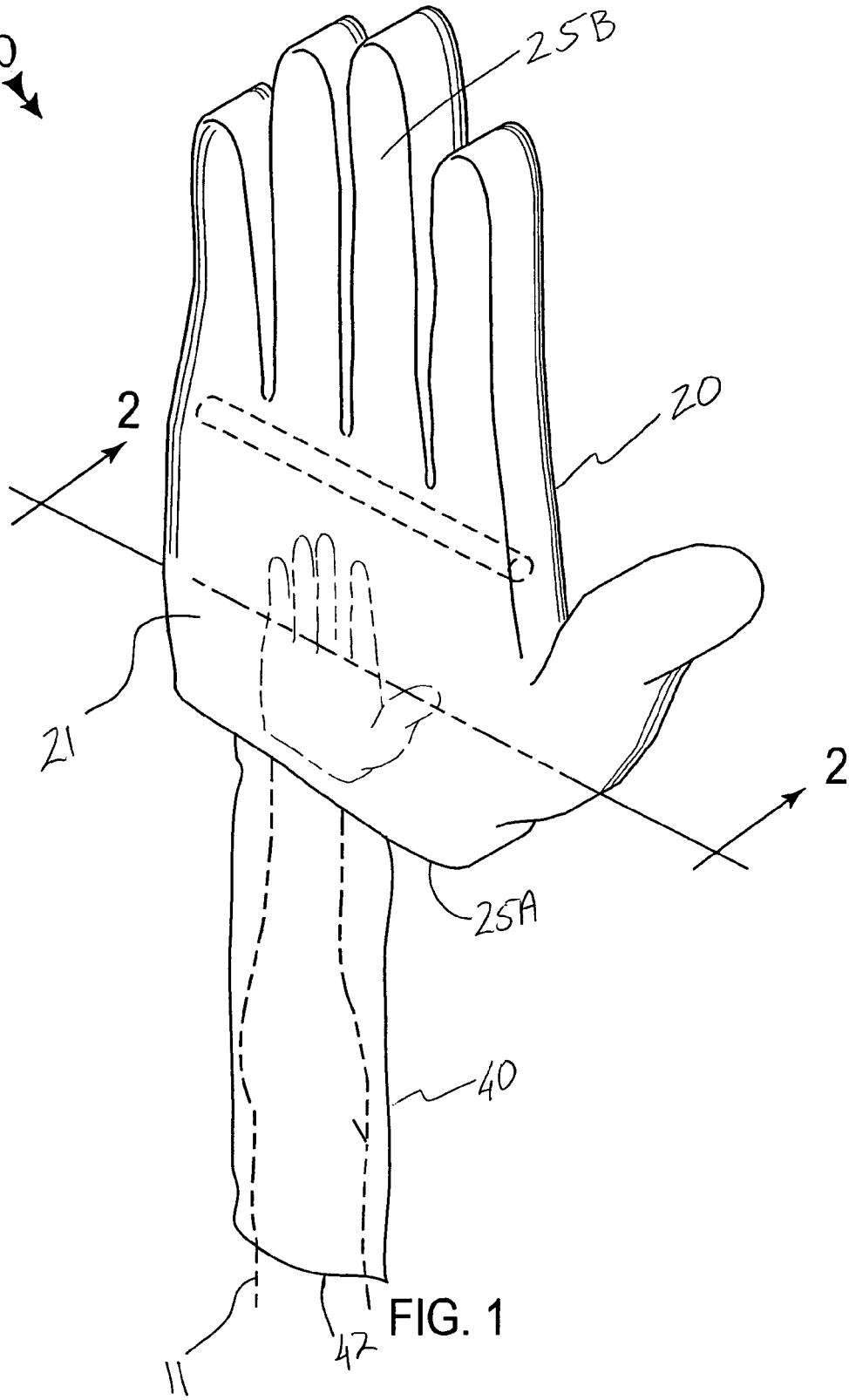
FIG. 1 is a perspective view showing a novelty noise generating apparatus, in accordance with the present invention.
Figure 2:
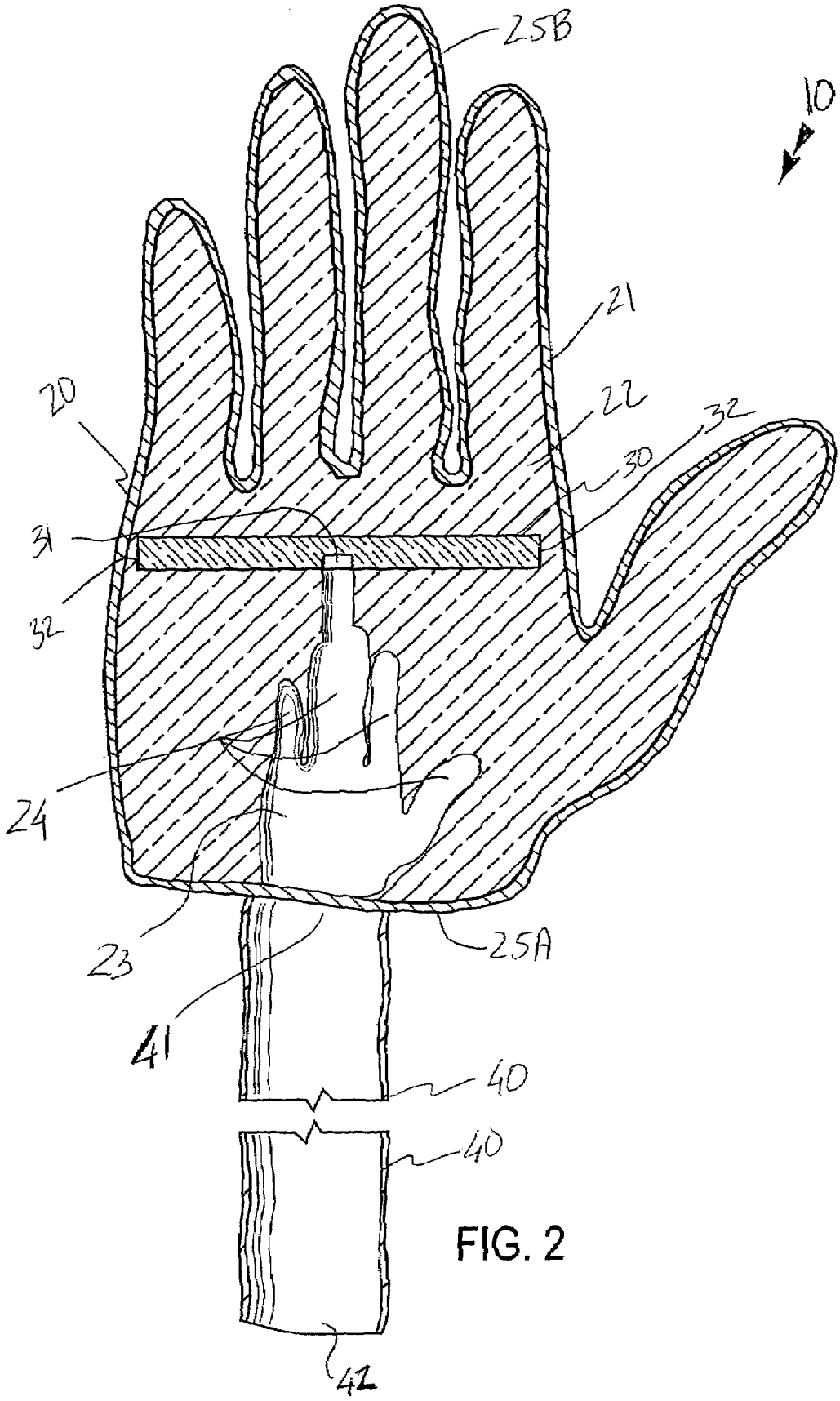
FIG. 2 is a cross-sectional view of the apparatus shown in FIG. 1, taken along line 2-2, and showing the stabilizing bar threaded aperture.
Figure 3:
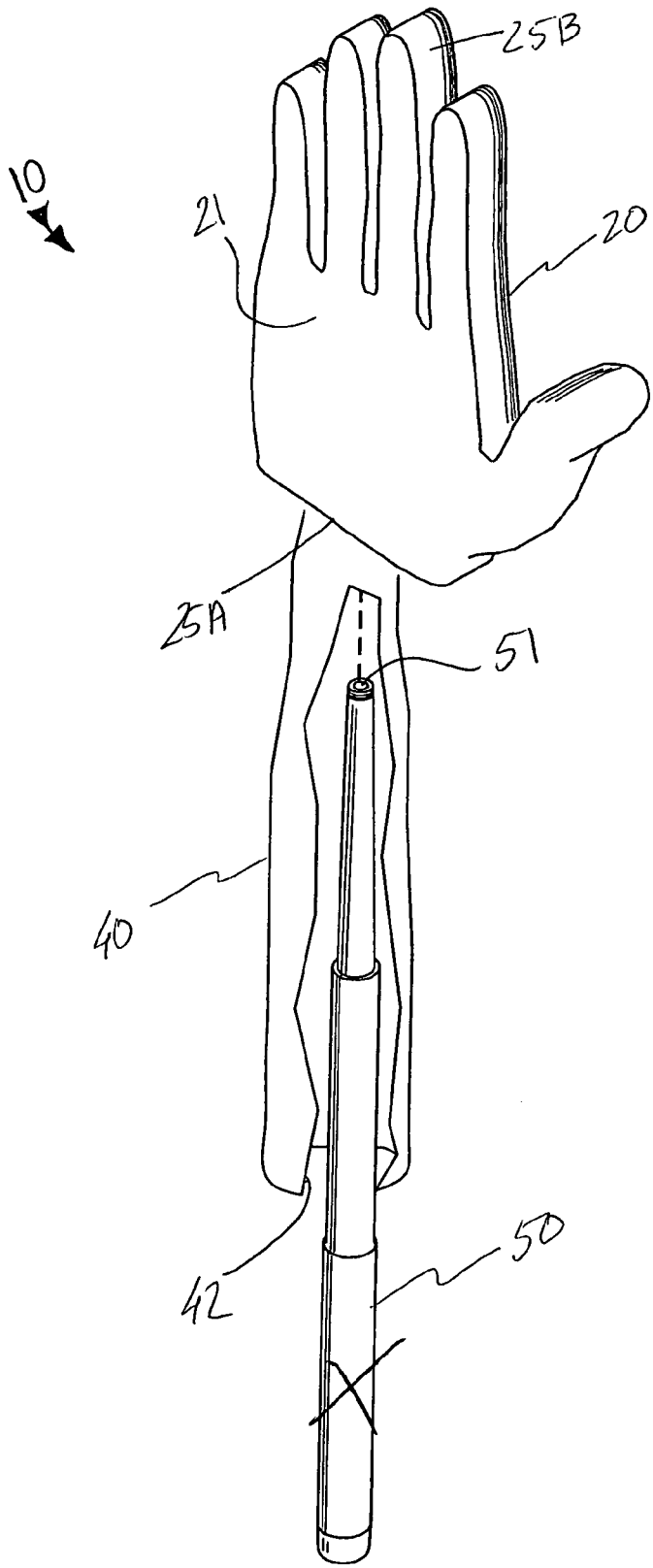
FIG. 3 is a perspective view of the apparatus shown in FIG. 1, showing the telescopically adjustable rod positioned therein.

The apparatus of this invention is referred to generally in FIGS. 1-3 by the reference numeral 10 and is intended to provide a novelty noise generating apparatus. It should be understood that the apparatus 10 may be used to generate noise in many different types of settings and should not be limited in use to only generating noise at arena sporting events.

Referring initially to FIGS. 1, 2 and 3, the apparatus 10 includes a body 20 shaped as a large open-faced hand made from deformably resilient material. Of course, the body 20 may be formed from a variety of alternate light materials and may be produced in an inflatable form, as is obvious to a person of ordinary skill in the art. Such a body 20 has an outer surface 21 formed from water-impermeable material and further has a solid core 22 monolithically formed with the outer surface 21.

The solid core 22 is provided with a cavity 23 that has a plurality of flanges 24 that are essential for effectively receiving a user's metacarpals therein such that a hand of the user penetrates upwardly from a bottom edge 25A of the body 20 and terminates subjacent midway to a top 25B of the body 20. Such a cavity 23 extends upwardly from the bottom edge 25A of the body 20 and abuts directly, without the use of intervening elements, to the stabilizing bar 30 (described herein below). Of course, the body 20 may be produced in a variety of alternate shapes, sizes and colors, and may feature the names and logos of professional or college sports teams on the outer surface 21, as is obvious to a person of ordinary skill in the art.

Referring to FIG. 2, a stabilizing bar 30 that has an elongated and rectilinear longitudinal length traverses across a longitudinal length of the body 20 such that the stabilizing bar 30 is seated within the solid core 22 and is intercalated between the outer layer 21, which is important so that the stabilizing bar 30 effectively defines a fulcrum axis about which a top region 25B of the body 20 articulates during side-to-side movement of the body 20. The stabilizing bar 30 is statically positioned within the body 20 as the top region 25B is repeatedly pivoted about the stabilizing bar 30. Such a stabilizing bar 30 further has a threaded aperture 31 formed at a midpoint of the longitudinal length thereof.

Referring to FIGS. 1, 2 and 3, a mechanism 40 is included for covering an arm 11 of the user, which is crucial such that the user's arm 11 is advantageously and effectively protected from undesirable air-traveling particulates during clapping conditions. Such an arm 11 of the user is invisible from an exterior of the arm covering mechanism 40 during operating conditions. The arm covering mechanism 40 is formed from flexible and water-impermeable material, which is vital for advantageously and conveniently prohibiting the user's arm 11 from becoming soaked during inclement weather conditions. Such an arm covering mechanism 40 is directly and permanently coupled, without the use of intervening elements, to the bottom edge 25A of the body 20. The arm covering mechanism 40 has open top 41 and bottom 42 ends and is in fluid communication with the cavity 23 and an exterior of the body 20 respectively.

Referring to FIG. 3, the apparatus 10 further includes a telescopically adjustable rod 50 that is removably inserted through the arm covering mechanism 40 and vertically upward into the cavity 23. Such a rod 50 has a threaded upper end 51 threadably conjoined directly, without the use of intervening elements, to the threaded aperture 31 of the stabilizing bar 30 and is medially disposed between axially opposed ends 32 thereof, which is essential so that the body 20 is effectively maintained at equilibrium when the rod is seated within the cavity 23. The rod 50 has a maximum longitudinal length that is shorter than a combined longitudinal length of the cavity 23 and the arm covering mechanism 40 respectively.

In use, an individual simply places an apparatus 20 one either, or on both of their arms 11. If two apparatuses 20 are employed a user can strike them together for generating a clapping noise. Alternately, two individuals can slap their respective apparatus 20 with that of the other individual's, in a mock "high five" fashion in order to show camaraderie and support of a team, respectively. Such a mock "high five" will also generate a slapping noise.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for creating loud, clapping and entertaining sounds during sports events and like recreational events, said apparatus comprising:

a body shaped as a large open-faced hand made from deformably resilient material, said body having an outer surface formed from water-impermeable material and further having a solid core monolithically formed with said outer surface, said solid core being provided with a cavity having a plurality of flanges for receiving user metacarpals therein such that a hand of the user penetrates upwardly from a bottom edge of said body and terminates subjacent midway to a top of said body;

a stabilizing bar having an elongated and rectilinear longitudinal length traversing across a longitudinal length of said body such that said stabilizing bar is seated within said solid core and intercalated between said outer layer such that said stabilizing bar defines a fulcrum axis about which a top region of said body articulates during side-to-side movement of said body, said stabilizing bar having a threaded aperture formed at a midpoint of the longitudinal length thereof; and means for covering an arm of the user such that the user arm is protected from undesirable air-traveling particulates during clapping conditions, said arm being invisible from an exterior of said arm covering means during operating conditions.

2. The apparatus of claim 1, wherein said arm covering means is directly and permanently coupled to said bottom edge of said body.

3. The apparatus of claim 1, wherein said arm covering means has open top and bottom ends and is in fluid communication with said cavity and an exterior of said body respectively.

4. The apparatus of claim 1, wherein said cavity extends upwardly from said bottom edge of said body and abuts directly to said stabilizing bar.

5. The apparatus of claim 1, further comprising:

a telescopically adjustable rod removably inserted through said arm covering means and vertically upward into said cavity, said rod having a threaded upper end threadably conjoined directly to said threaded aperture of said stabilizing bar and medially disposed between axially opposed ends thereof so that said body is maintained at equilibrium when the user arm is seated within said cavity.

6. The apparatus of claim 5, wherein said rod has a maximum longitudinal length that is shorter than a combined longitudinal length of said cavity and said arm covering means respectively.

7. An apparatus for creating loud, clapping and entertaining sounds during sports events and like recreational events, said apparatus comprising:

a body shaped as a large open-faced hand made from deformably resilient material, said body having an outer surface formed from water-impermeable material and further having a solid core monolithically formed with said outer surface, said solid core being provided with a cavity having a plurality of flanges for receiving user metacarpals therein such that a hand of the user penetrates upwardly from a bottom edge of said body and terminates subjacent midway to a top of said body;

a stabilizing bar having an elongated and rectilinear longitudinal length traversing across a longitudinal length of said body such that said stabilizing bar is seated within said solid core and intercalated between said outer layer such that said stabilizing bar defines a fulcrum axis about which a top region of said body articulates during side-to-side movement of said body, wherein said stabilizing bar is statically positioned within said body as said top region is repeatedly pivoted about said stabilizing bar, said stabilizing bar having a threaded aperture formed at a midpoint of the longitudinal length thereof; and means for covering an arm of the user such that the user arm is protected from undesirable air-traveling particulates during clapping conditions, said arm being invisible from an exterior of said arm covering means during operating conditions.

8. The apparatus of claim 7, wherein said arm covering means is directly and permanently coupled to said bottom edge of said body.

9. The apparatus of claim 7, wherein said arm covering means has open top and bottom ends and is in fluid communication with said cavity and an exterior of said body respectively.

10. The apparatus of claim 7, wherein said cavity extends upwardly from said bottom edge of said body and abuts directly to said stabilizing bar.

11. The apparatus of claim 7, further comprising:

a telescopically adjustable rod removably inserted through said arm covering means and vertically upward into said cavity, said rod having a threaded upper end threadably conjoined directly to said threaded aperture of said stabilizing bar and medially disposed between axially opposed ends thereof so that said body is maintained at equilibrium when the user arm is seated within said cavity.

12. The apparatus of claim 11, wherein said rod has a maximum longitudinal length that is shorter than a combined longitudinal length of said cavity and said arm covering means respectively.

13. An apparatus for creating loud, clapping and entertaining sounds during sports events and like recreational events, said apparatus comprising:

a body shaped as a large open-faced hand made from deformably resilient material, said body having an outer surface formed from water-impermeable material and further having a solid core monolithically formed with said outer surface, said solid core being provided with a cavity having a plurality of flanges for receiving user metacarpals therein such that a hand of the user penetrates upwardly from a bottom edge of said body and terminates subjacent midway to a top of said body;

a stabilizing bar having an elongated and rectilinear longitudinal length traversing across a longitudinal length of said body such that said stabilizing bar is seated within said solid core and intercalated between said outer layer such that said stabilizing bar defines a fulcrum axis about which a top region of said body articulates during side-to-side movement of said body, wherein said stabilizing bar is statically positioned within said body as said top region is repeatedly pivoted about said stabilizing bar, said stabilizing bar having a threaded aperture formed at a midpoint of the longitudinal length thereof; and means for covering an arm of the user such that the user arm is protected from undesirable air-traveling particulates during clapping conditions, said arm being invisible from an exterior of said arm covering means during operating conditions, wherein said arm covering means is formed from flexible and water-impermeable material for prohibiting the user arm from becoming soaked during inclement weather conditions.

14. The apparatus of claim 13, wherein said arm covering means is directly and permanently coupled to said bottom edge of said body.

15. The apparatus of claim 13, wherein said arm covering means has open top and bottom ends and is in fluid communication with said cavity and an exterior of said body respectively.

16. The apparatus of claim 13, wherein said cavity extends upwardly from said bottom edge of said body and abuts directly to said stabilizing bar.

17. The apparatus of claim 13, further comprising:

a telescopically adjustable rod removably inserted through said arm covering means and vertically upward into said cavity, said rod having a threaded upper end threadably conjoined directly to said threaded aperture of said stabilizing bar and medially disposed between axially opposed ends thereof so that said body is maintained at equilibrium when the user arm is seated within said cavity.

18. The apparatus of claim 17, wherein said rod has a maximum longitudinal length that is shorter than a combined longitudinal length of said cavity and said arm covering means respectively.

* * * * *